US010769943B2

(12) United States Patent
Royal

(10) Patent No.: US 10,769,943 B2
(45) Date of Patent: Sep. 8, 2020

(54) SYSTEM AND APPARATUS FOR WIRELESS CONTROL AND COORDINATION OF TRAFFIC LIGHTS

(71) Applicant: Traffic Synergies, LLC, Jacksonville, FL (US)

(72) Inventor: Richard Wayne Royal, Green Cove Springs, FL (US)

( * ) Notice: Subject to any disclaimer, the term of this patent is extended or adjusted under 35 U.S.C. 154(b) by 0 days.

(21) Appl. No.: 16/235,004

(22) Filed: Dec. 28, 2018

(65) Prior Publication Data

US 2019/0206245 A1 Jul. 4, 2019

Related U.S. Application Data

(60) Provisional application No. 62/611,582, filed on Dec. 29, 2017.

(51) Int. Cl.
*G08G 1/081* (2006.01)
*G08G 1/08* (2006.01)

(52) U.S. Cl.
CPC ..... *G08G 1/081* (2013.01); *G08G 1/08* (2013.01)

(58) Field of Classification Search
CPC ..... G08G 1/081; G08G 1/07; G08G 1/087; F21S 8/086
See application file for complete search history.

(56) References Cited

U.S. PATENT DOCUMENTS

| | | | | |
|---|---|---|---|---|
| 4,257,029 | A * | 3/1981 | Stevens | G08G 1/081 340/4.21 |
| 4,462,031 | A | 7/1984 | Johnson | |
| 5,822,711 | A | 10/1998 | Ochoa-Chavez | |
| 6,441,749 | B1 * | 8/2002 | Edwards | G08G 1/087 340/902 |
| 8,922,392 | B1 | 12/2014 | Chandra et al. | |
| 2005/0104745 | A1 * | 5/2005 | Bachelder | F41G 9/00 340/906 |
| 2008/0198038 | A1 * | 8/2008 | Yingst | G08G 1/087 340/908 |
| 2008/0235398 | A1 * | 9/2008 | Helbing | G08G 1/07 709/243 |
| 2010/0026520 | A1 * | 2/2010 | Witte | G08G 1/07 340/908 |
| 2011/0043378 | A1 * | 2/2011 | Bailey | G08G 1/07 340/917 |

* cited by examiner

*Primary Examiner* — Brian A Zimmerman
*Assistant Examiner* — Kevin Lau
(74) *Attorney, Agent, or Firm* — Wilson Dutra, PLLC; Camile A. Wilson

(57) ABSTRACT

The present disclosure provides an apparatus and system that may allow a user to facilitate the flow of traffic over contained environments or otherwise. This apparatus and system may improve management for the flow of traffic by providing a lower barrier for entry for municipalities and other entities to collaborate on traffic management. In some embodiments, those in control may create a tiered system for a series of lights within a connected block. In some implementations, those in control may create a tiered system over a larger grid system, such as an entire neighborhood, district, city, or state. In some aspects, the apparatus and system may allow those in control to set priorities for how to handle developing traffic conditions.

20 Claims, 9 Drawing Sheets

200

SYSTEM AND APPARATUS FOR WIRELESS CONTROL AND COORDINATION OF TRAFFIC LIGHTS

CROSS-REFERENCE TO RELATED APPLICATION

This application claims priority to and the full benefit of U.S. Provisional Patent Application Ser. No. 62/611,582, filed Dec. 29, 2017, and titled "SYSTEM AND APPARATUS FOR WIRELESS CONTROL AND COORDINATION OF TRAFFIC LIGHTS", the entire contents of which are incorporated in this application by reference.

BACKGROUND OF THE DISCLOSURE

The average United States commuter spends approximately 42 hours in traffic per year. In 2016, this averaged to about $1,400 per driver in gasoline expenses. These amounts may vary widely depending on the city, with more heavily populated cities commuters spending even more time and money due to frequent stop-and-go traffic. For example, commuters in Miami, Fla. averaged 65 hours in traffic and a cost of about $1,800 per driver while commuters in Los Angeles, Calif. averaged 104 hours in traffic and about $2,400 per driver. Though traffic accidents play into the transit times in larger cities, in smaller cities and towns traffic controls typically dictate the flow of traffic.

Traditionally, traffic control signals incorporated different types of technologies that may detect cars, such as timers, lasers, rubber hoses filled with air, and an inductive loop. With such a wide range of technology available to regulate traffic, some lights do not have any sort of traffic detection. In large cities, traffic lights may operate on timers. In suburbs and country roads, traffic detectors may be common. Detectors may trigger when a car arrives at an intersection, when too many cars are at an intersection, or when cars have entered a turn lane, so that the detector may activate the arrow light.

The most common form of traffic control is an inductive loop. The inductive loop is a coil of wire embedded in a road's surface. Vehicle presence is detected through electromagnetic induction, where a vehicle triggers the inductive loop to signal the traffic controller that there is traffic waiting at the intersection. Typically, the inductive loop is triggered just before the stop bar in a traffic lane, which is the thick white line painted on the pavement that signals to motorists where they should stop so that the traffic controller may detect effectively.

Traffic sensors associated with preemption systems are programmed to only detect certain infra-red signals from emergency vehicles and cannot be deceived by activating a green light for passenger vehicles.

Currently, most traffic lights are poorly timed and inefficient because transportation agencies do not have the personnel or financial resources to update these systems or to implement newer traffic technologies that could reduce delay at intersections. Without experienced personnel or money for updates and improvements, cities and rural areas are unable to improve the efficiency of their traffic control systems and motorists, and by default, people waste time, fuel, and, ultimately, money, due to traffic mismanagement.

SUMMARY OF THE DISCLOSURE

What is needed is an apparatus and system that may allow a user to facilitate the flow of traffic over contained environments or otherwise. This apparatus and system may improve management for the flow of traffic by providing a lower barrier for entry for municipalities and other entities to collaborate on traffic management. In some embodiments, those in control may create a tiered system for a series of lights within a connected block. In some implementations, those in control may create a tiered system over a larger grid system, such as an entire neighborhood, district, city, or state. In some aspects, the apparatus and system may allow those in control to set priorities for how to handle developing traffic conditions.

In some aspects, the present disclosure relates to a traffic light system for managing traffic flow. In some embodiments, the traffic light system may comprise a first master light comprising a traffic light located at a first intersection within a predefined geography; a first subordinate light located at a second intersection within the predefined geography, wherein the first subordinate light is responsive to the first master light; a first set of setting priorities, wherein the first set of setting priorities determine an order of priority of responsiveness between the first master light and the first subordinate light; and at least a first precision timing mechanism in logical communication with at least the first master light, wherein the first precision timing mechanism is configured to synchronize responsiveness between the first master light and the first subordinate light.

In some embodiments, the first subordinate light may be part of a subordinate light group comprising a plurality of subordinate lights, wherein a first set of setting priorities may control a hierarchy between the plurality of subordinate lights and the first master light. In some implementations, one or more of the first master light and the plurality of subordinate lights may be triggerable by action conditions, wherein an action condition comprises an external condition. In some aspects, at least one action condition may comprise an emergency vehicle proximity.

In some embodiments, a first master light and a first subordinate light may be located at a first intersection, wherein the first master light may control a first direction and the first subordinate light may control a second direction. In some aspects, the first direction may be perpendicular to the second direction. In some embodiments, the first direction may be opposite to the second direction. In some implementations, the first intersection may further comprise a second subordinate light.

In some embodiments, the present disclosure may relate to a traffic light system comprising a plurality of master lights comprising traffic lights located at a first plurality of intersections within a predefined geography; a plurality of subordinate lights located at a second plurality of intersections within the predefined geography, wherein each of the plurality of master lights controls at least one of the plurality of subordinate lights and each of the subordinate lights is controllable by at least one of the plurality of master lights; a plurality of setting priorities, wherein the plurality of setting priorities determine an order of priority of responsiveness between the plurality of master lights and the plurality of subordinate lights; and at least one precision timing mechanism in logical communication with at least one of the plurality of master lights, wherein the at least one precision timing mechanism is configured to synchronize responsiveness between the at least one of the plurality of master lights and at least one of the plurality of subordinate lights controllable by the at least one of the plurality of master lights.

In some aspects, the precision timing mechanism may comprise an atomic clock. In some implementations, one or more of the plurality of subordinate lights and the plurality of master lights may be triggerable by at least one action condition, wherein an action condition comprises an external condition. In some embodiments, the first plurality of intersections at least partially overlap with the second plurality of intersections. In some aspects, at least one action condition may comprise an emergency vehicle proximity.

In some aspects, the present disclosure may relate to a synchronization device for managing a traffic light system comprising a precision timing mechanism; a processor logically connectable to a system of traffic lights comprising a plurality of traffic lights, wherein the processor when connected to the system of traffic lights, is configured to designate at least one master light from the plurality of traffic lights; designate at least one subordinate light from the plurality of traffic lights; impose settings priorities on the at least one master light and the at least one subordinate light; and synchronize the at least one master light and the at least one subordinate light, wherein synchronization is at least partially based on timing data received from the precision timing mechanism.

In some embodiments, the device may be configured to removably integrate into an existing traffic light system. In some aspects, the device may be configured to integrate into a new traffic light system. In some implementations, the device may be programmable, wherein programming may control one or more of master light designation, subordinate light designation, and settings priorities. In some embodiments, the device may be wirelessly programmable. In some implementations, the processor may be further configured to associate at least one action condition with one or more designated master lights and designated subordinate lights. In some aspects, the device may be logically connected to sensors of the system of traffic lights.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

DETAILED DESCRIPTION

Figure 1:
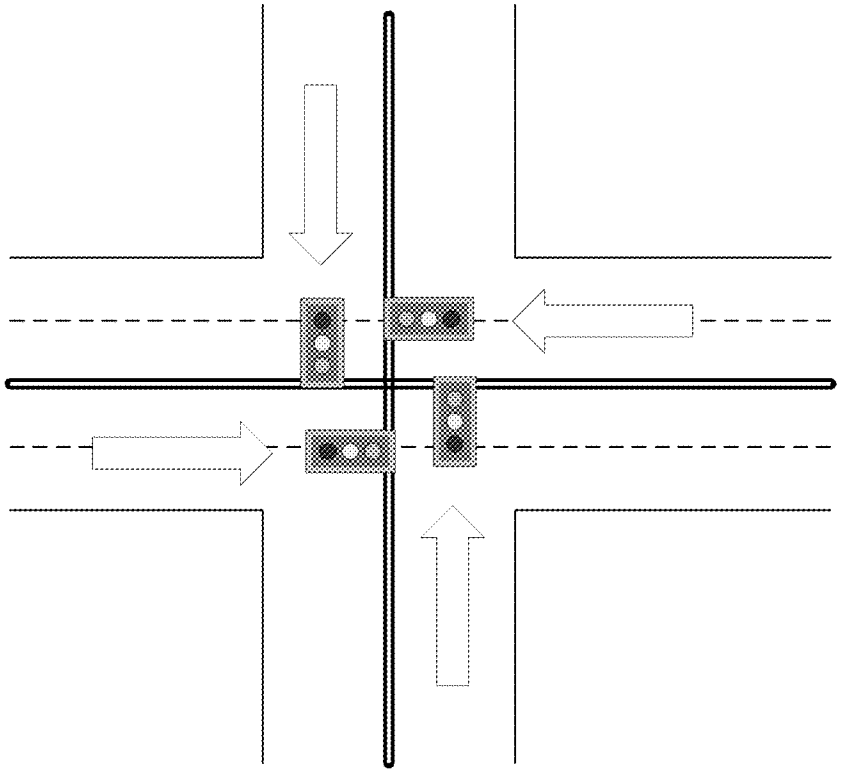
FIG. 1 illustrates an intersection with an exemplary traffic light system, according to some embodiments of the present disclosure

The present disclosure provides generally for an improved system for managing the flow of traffic. More specifically, the present disclosure relates to a traffic light system that more effectively and efficiently manages traffic flow and traffic light synchronization.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Traffic Light: as used herein refers to any light device that may be used to control the flow of traffic.

Master Light: as used herein refers to any traffic light that may serve as a controlling light for subordinate lights. In some implementations, a system may comprise multiple master lights. For example, the lights controlling a primary road may comprise one or more master lights. In some embodiments, a master light may be manually controlled, set, or overridden. In some aspects, changes to setting or timing of a master light may affect the master light and related subordinate lights.

Subordinate Light: as used herein refers to any traffic light that may synchronize (sync) or coordinate in response to a master light. In some aspects, a subordinate light may be manually overridden or controlled, wherein a manual override may affect timing of the subordinate light. In some embodiments, manual control of a subordinate light may not affect a master light or other subordinate lights. In some implementations, manual control of a subordinate light may affect some subordinate lights based on setting priorities.

Setting Priorities: as used herein refers to priorities of subordinate lights relative to a master light or master lights, wherein the setting priorities may control the order of responsiveness to action conditions of subordinate lights. In some aspects, setting priorities may identify overriding action conditions, which may be prioritized higher than a master light. For example, traffic associated with a master light may be prioritized over other subordinate lights but may be lower priority than the presence of an emergency vehicle. In some embodiments, setting priorities may determine hierarchy of response between master lights and subordinate lights.

Action Conditions: as used herein refers to external conditions that may trigger a system response in one or more lights. In some implementations, action conditions may involve traffic associated with a particular intersection. In some embodiments, an action condition may occur nearby that may affect the flow of traffic. For example, an action condition may comprise the presence of an emergency vehicle.

Precision Timing Mechanism: as used herein refers to a timer that may be installed on a traffic light, wherein timing data may allow for one or both precise synchronization between traffic lights and accurate synchronization with traffic patterns. In some aspects, a precision timing mechanism may comprise a local timer, such as an atomic clock. In some embodiments, a precision timing mechanism may comprise a receiver with access to an offsite clock, such as a satellite clock.

Referring now to FIG. 1, an intersection 100 with an exemplary traffic light system is illustrated. In some aspects, an intersection 100 may comprise two intersecting streets with four traffic lights, wherein a traffic light may govern each direction for each street. In some implementations, a traffic light system may comprise at least one master light and at least one subordinate light. In some embodiments, traffic flow from one direction may generally be more substantial than another direction, such as where one direction originates from a small neighborhood and the opposite direction originates from a busy highway.

In some aspects, the traffic flow for an intersection 100 may vary, such as by date, time, event, or day of the week. For example, traffic flow may increase during rush hour and decrease on weekends. In some implementations, the traffic flow may vary between the different directions during different times. For example, one direction may be congested during the morning rush hour, and the opposite direction may be congested during the evening rush hour.

Figure 2:
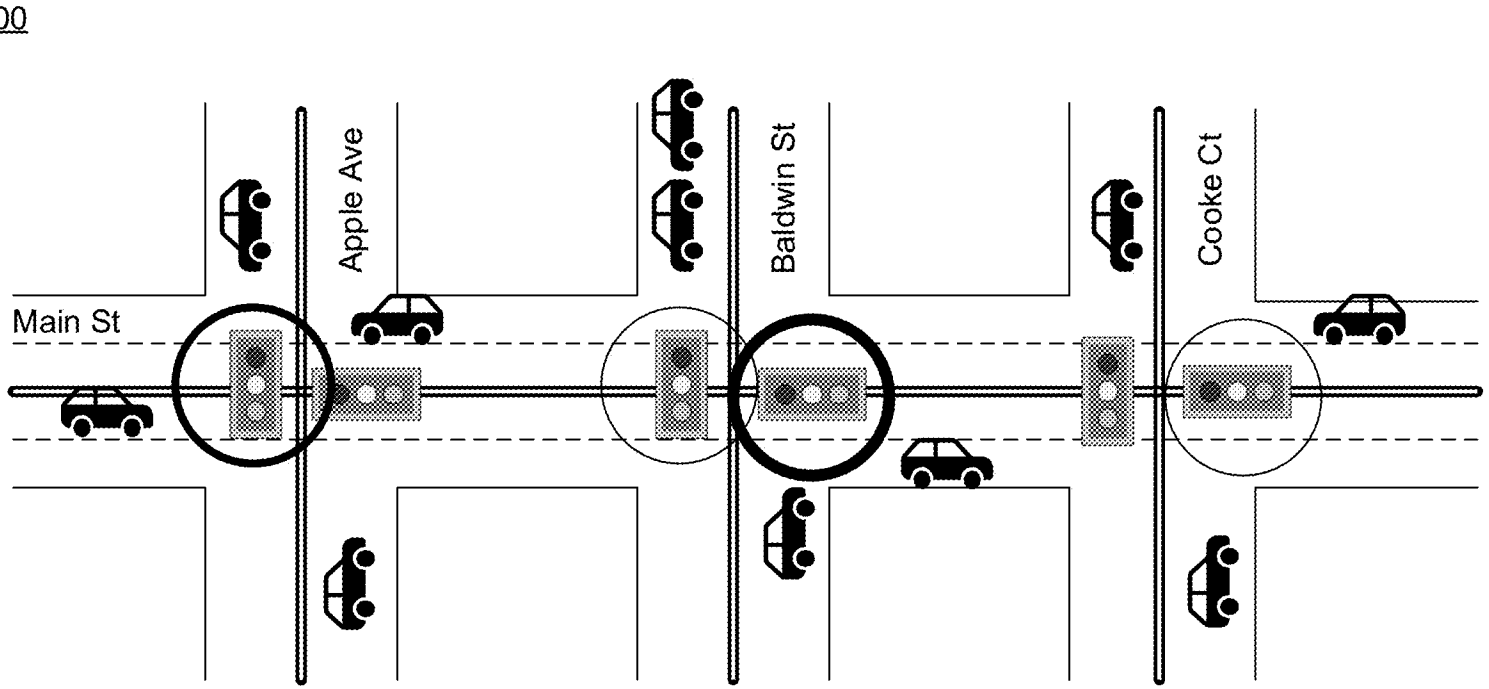
FIG. 2 illustrates an exemplary traffic light system, according to some embodiments of the present disclosure.

Referring now to FIG. 2, an exemplary traffic light system 200 is illustrated. In some aspects, a synchronization device may removably integrate with an existing traffic light system, wherein the device may allow for advanced synchronization and traffic light management. The device may comprise a precision timing mechanism that is configured for accurate and precise timing and control.

In some aspects, the device may comprise a processor logically connectable to one or more traffic lights, wherein the processor is configured to designate master lights, designate subordinate lights, and impose settings priorities. In some embodiments, the device may be integrated with a new traffic light system. In some implementations, traffic lights may be equipped with sensors, such as to monitor traffic flow, proximity of emergency vehicles, or other action conditions, as non-limiting examples. In some aspects, the processor may be logically connectable to external controls, such as through wireless connection, direct line connection, or near field communication, as non-limiting examples.

In some embodiments, a traffic light may permanently be designated as a master light, such as at Main Street and Apple Avenue, wherein any designated subordinate lights may be responsive to the master light. In some aspects, a master light designation may be temporary, such as during rush hour, major events, weekends, or when school ends, as non-limiting example. A temporary designation may allow for a dynamic management of a traffic light system. In some aspects, a primary light may be designated as a master light, such as at Main Street and Apple Avenue, and a secondary light may periodically be designated as a master light, such as at Baldwin Street and Main Street, wherein a settings priority may allow for the secondary light to override the primary light during certain circumstances.

In some embodiments, traffic lights may be designated as subordinate lights, such as at Baldwin Street and Main Street and Cooke Court and Main Street. The traffic flow at those intersections in a particular direction may be less than surrounding intersections or directions. In some aspects, a subordinate light may be responsive to another subordinate light, wherein the responsiveness allows for a synchronized flow of traffic within a predefined geographic area. For example, triggering a green light at one subordinate light may prompt a subsequent subordinate light to turn green after a defined amount of time, such as the time it typically may take a car to move between the intersections.

In some embodiments, traffic flow data for a geographic region may be collected and analyzed, wherein traffic flow patterns and trends may be identified and defined. In some aspects, traffic flow patterns and trends may be known and predictable for a geographic region. As an example, a geographic region may comprise a defined segment of road and any intersecting roads for that stretch. As another example, a geographic region may comprise a grid of intersections. A precision timing mechanism integrated with one or more traffic light or system may allow for the accurate synchronization of traffic lights within a geographic region. In some aspects, traffic flow may be at least partially linked to an event, such as a train crossing, school hours, a bridge going up, as non-limiting examples.

In some embodiments, artificial intelligence may be integrated with the traffic light system and analysis of traffic flow data. In some aspects, historical traffic flow data may be used to create predictive algorithms that may govern the traffic light system, such as designating master and subordinate lights, creating a settings priorities, identifying action conditions, and setting light patterns, as non-limiting examples. In some embodiments, historical data may be combined with third party data, such as from school districts, venues, or transportation schedules.

As an illustrative example, Baldwin Street may be congested every day from 3:15 pm to 4:47 pm, and a green light that lasts for 1.2 minutes every 8 minutes may reduce traffic flow issues. The historical data indicating the hours of congestion may be combined with external data, and it may be determined that the congestion is related to a daily train crossing three intersections from Baldwin Street. The system may allow for predictive synchronization for trains that cross outside of the scheduled times based on the historical data. In some implementations, the traffic light system may be paired with external system that may provide real time data, such as an alert that a train will be crossing in thirty minutes. This may allow for a proactive management of the traffic flow.

Figure 3:
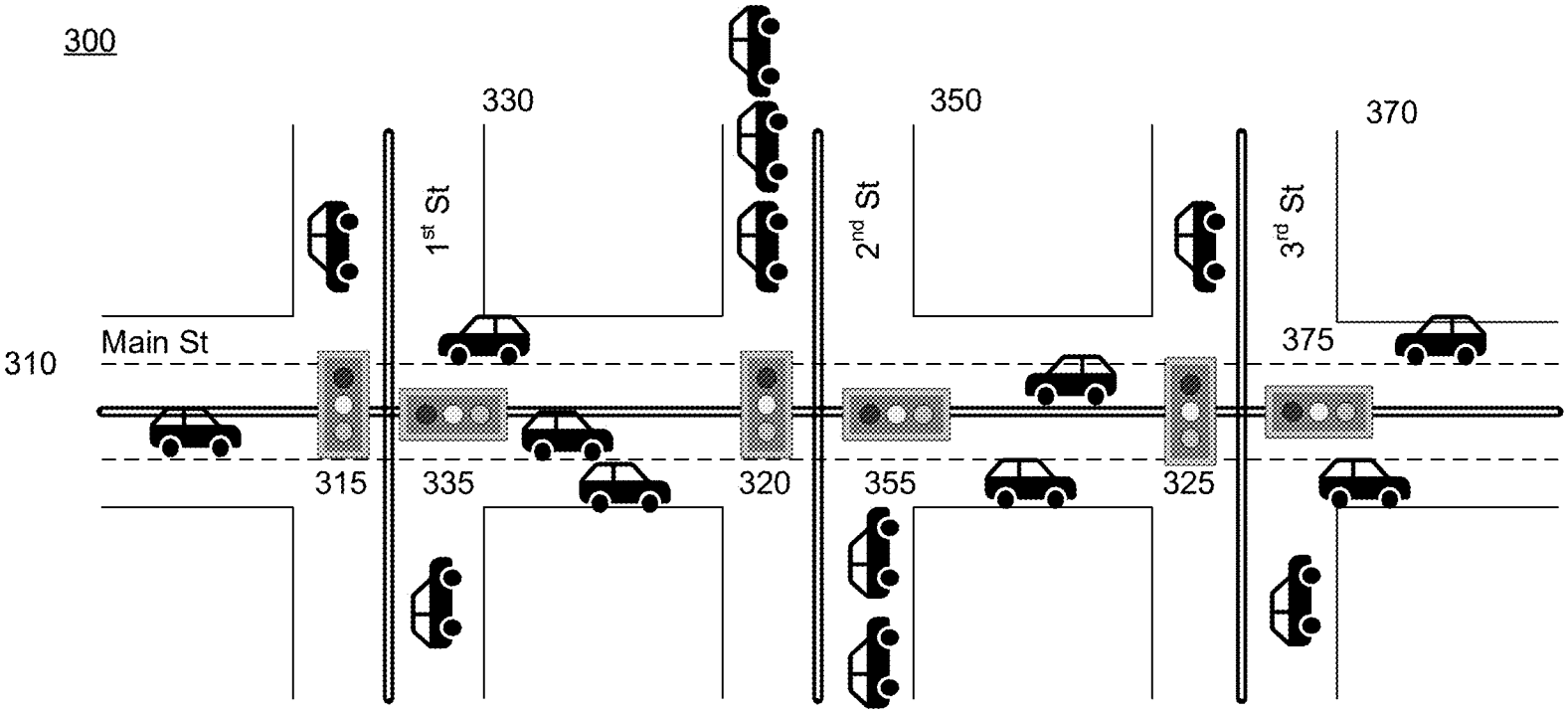
FIG. 3 illustrates an exemplary traffic light system, according to some embodiments of the present disclosure.

Referring now to FIG. 3, an exemplary traffic light system 300 is illustrated. In some aspects, a traffic light system 300 may comprise a main street 310 and a series of crossroads 330, 350, 370, wherein each intersection may comprise a master light 315, 320, 325 and a subordinate light 335, 355, 375. In some embodiments, the traffic patterns on the main street 310 may set the base traffic light patterns for the traffic light system 300.

In some aspects, one or more of the traffic lights 315, 320, 325, 335, 355, 375 may comprise a precision timing mechanism, which may allow for precise synchronization between the traffic lights 315, 320, 325, 335, 355, 375. In some aspects, one or more master lights 315, 320, 325 may comprise a precision timing mechanism, and the subordinate light 335, 355, 375 may synchronize with the master lights 315, 320, 325 through a separate mechanism.

As an illustrative example, the master lights 315, 320, 325 may comprise atomic clocks, and the subordinate lights 335, 355, 375 may sync based on a wired or wireless connection with the master lights 315, 320, 325, wherein the subordinate lights 335, 355, 375 may not comprise a separate precision timing mechanism.

As another example, the traffic lights 315, 320, 325, 335, 355, 375 may comprise a receiver device that may periodically receive timing information from satellite clocks. In some aspects, the master lights 315, 320, 325 may receive timing information more frequently than subordinate lights 335, 355, 375. For example, the master lights 315, 320, 325 may receive timing information throughout the day, such as right before a traffic event that may prompt a change in setting priorities or when an action condition may be detected, and all or most of the traffic lights 315, 320, 325, 335, 355, 375 may receive timing information during a down moment in the traffic patterns, such as at 3 a.m., which may allow for precision synchronization between the traffic lights 315, 320, 325, 335, 355, 375.

In some implementations, the traffic patterns may be preprogrammed into the traffic light system 300, which may be appropriate where traffic patterns may be predictable. For example, during the weekdays, the main street 310 may have constant traffic for the majority of the day, dense traffic during normal rush hour and lunch times, and sporadic traffic from 10 p.m. to 5 a.m., while during the weekend, the main street 310 may have sporadic traffic for most of the day and dense traffic during brunch times.

In some embodiments, the setting priorities may determine the order of addressing traffic flow. As an illustrative example, Main Street 310 may be the primary road wherein managing traffic flow on Main Street may be prioritized over traffic flow on any of the crossroads 330, 350, 370. After Main Street, $2^{nd}$ Street 350 may frequently become congested, such as because of a nearby business center or shopping center, and a build up of traffic on $2^{nd}$ Street 350 may comprise an action condition that may trigger the $2^{nd}$ Street subordinate light 355 to become green, which may affect the $2^{nd}$ Street master light 320. In some embodiments, a change in traffic light patterns to one master light 315, 320, 325 may trigger a change to connected master lights 315, 320, 325.

In continuing the illustrative example, $3^{rd}$ Street 370 may be connected to a densely populated residential community, and $1^{st}$ Street 330 may lead to a series of sporadic farmland. Accordingly, the traffic flow on $3^{rd}$ Street 370 may be lower priority to $2^{nd}$ Street 350 and higher priority to $1^{st}$ Street. In some aspects, the action conditions of each intersection may be similar or different. For example, the action conditions of each intersection may comprise a predefined threshold traffic congestion level, such as two cars on either side of the crossroad 330, 350, 370 waiting for at least 3 minutes.

As another example, each crossroad 330, 350, 370 may have different action conditions. For example, for $2^{nd}$ Street 350, an action condition may comprise two cars on either side waiting for three minutes; for $3^{rd}$ Street 370, an action condition may comprise four cars on the side of the residential community waiting for two minutes; and for $1^{st}$ Street, an action condition may comprise three cars on both sides waiting for two minutes or five cars on either side waiting for five minutes.

In some embodiments, the action conditions may be periodically adjusted, such as based on seasonal activity or construction. For example, the residential community may be a seasonal community, wherein the majority of residents may live in a different location during certain seasons. Accordingly, one or both the setting priorities may shift and the action conditions may change during the off season. As another example, construction of a shopping plaza off of $1^{st}$ Street 330 may cause a change in setting priorities. In a still further example, ongoing construction in a particular location may comprise an action condition.

In areas that may lack extensive budgets for transportation infrastructure, the traffic light system 300 may be installed on preexisting traffic lights, which may allow for integration of the technology. In some aspects, the traffic light system 300 may pair with existing accessories, such as sensors that may monitor the presence of traffic, which may comprise an action condition. In some embodiments, the traffic light system 300 may be integrated in new traffic light installations, which may allow for more extensive control and options for coordination.

Figure 4:
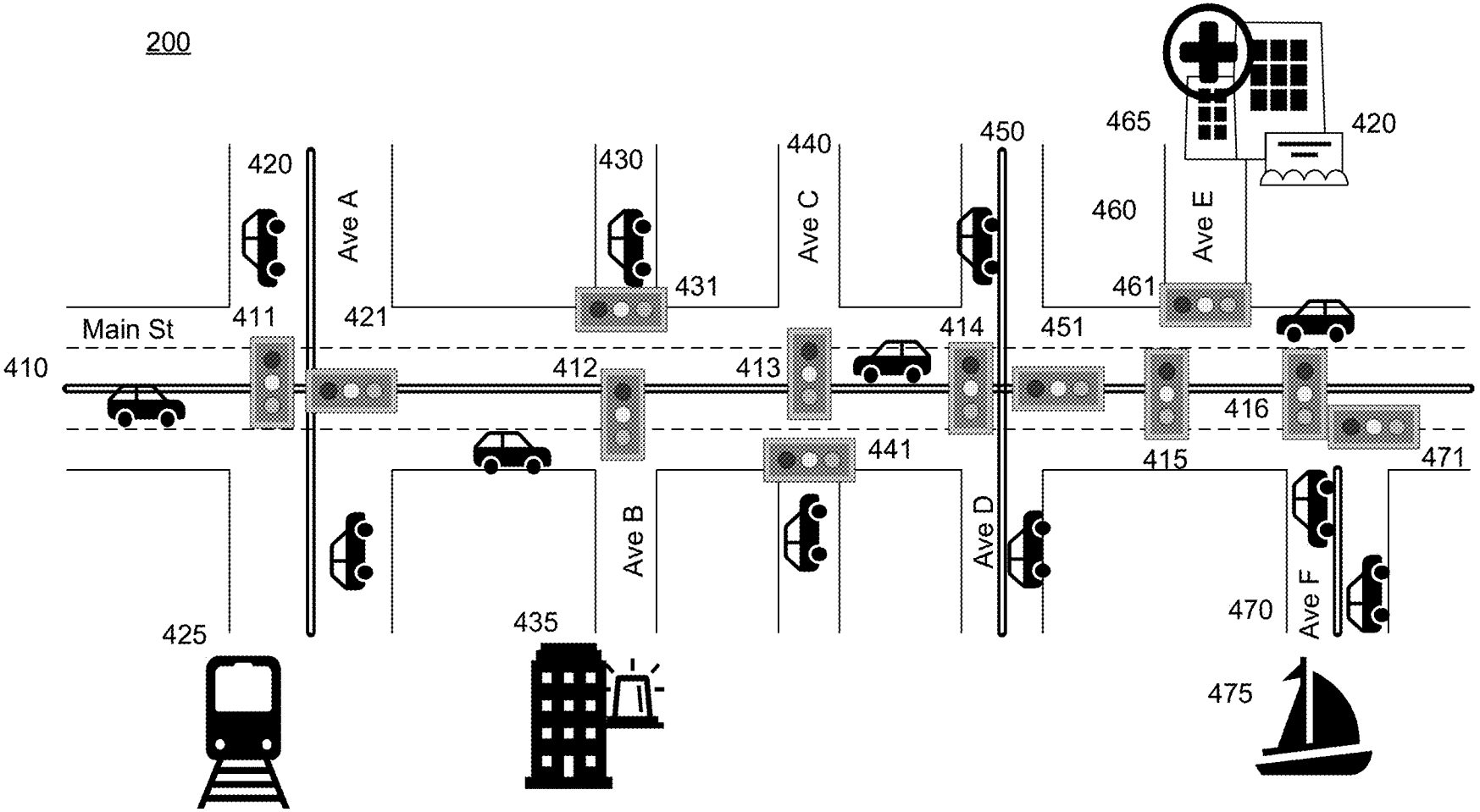
FIG. 4 illustrates an alternate exemplary traffic light system, according to some embodiments of the present disclosure.

Referring now to FIG. 4, an alternate exemplary traffic light system 400 is illustrated. In some aspects, a traffic light system 400 may comprise a main street 410 and a series of crossroads 420, 430, 440, 450, 460, 470, wherein each intersection may comprise a master light 411-416 and a subordinate light 421, 431, 441, 451, 461, 471. As described in FIG. 1, some basic traffic flow patterns may be preprogrammed into the traffic light system 400 based on known or predictable traffic flow patterns, and the priority settings between the master lights 411-416 and the subordinate lights 421, 431, 441, 451, 461, 471 may be based on the predictable traffic flow patterns, wherein at least some of the action conditions may be based on traffic congestion.

In some aspects (not shown), an intersection may comprise multiple lights, wherein within the intersection, there may be a mix of master and subordinate lights. For example, an intersection may comprise sixteen separate lights, such as those for straight only lanes and turn only lanes. The master lights may comprise those for straight only lanes on the primary road, and the setting priorities may vary between the subordinate lights within the same intersection. For example, the action conditions for the straight only lane lights of the secondary road may rank lower than the action conditions of the turn only lane lights for the primary road.

In some aspects, traffic light systems 400 may be interconnected, such as where a main thoroughfare may extend for long distances over multiple areas, such as cities, towns, counties, and states. In some embodiments, interconnected traffic light systems 400 may have some communication, which may allow for synchronization of some or all of the traffic lights based on setting priorities. For example, three traffic light systems may be linked, wherein each traffic light system has a priority relative to the other traffic light systems and internal priority settings that may govern the infrastructure within the traffic light system 400.

Intercommunication may allow for traffic flow management over larger areas. In some implementations, a traffic light system 400 may be managed in isolation from other surrounding traffic light systems, such as where the installation of the traffic light system 400 may be an exception or where the traffic light system 400 may manage a rural area whose traffic may not significantly impact other areas.

In some embodiments, some crossroads 420, 430, 460, 470 may be proximate to sites that may warrant action conditions beyond traffic congestion. For example, train tracks 425 may be located near the intersection of Ave A 420 and Main Street 410, wherein the presence of a train may comprise an action condition. A fire or police station 435 may be located near the intersection of Ave B 430 and Main Street 410, wherein the need for an emergency vehicle to enter the intersection may comprise an action condition. Avenue E 460 may lead directly to a hospital 465, wherein the need for an emergency vehicle to leave or reach the hospital 465 may comprise an action condition, allowing for easy access for emergency vehicles. Avenue F may lead to a waterway 475 with a drawbridge, and the need to raise the drawbridge may comprise an action condition, limiting traffic congestion on Avenue F.

In some aspects, the presence of an emergency vehicle may comprise an action condition, which may prompt a change in the traffic light patterns based on traffic light priorities. In some embodiments, the presence of an emergency vehicle may be detected by local sensors on or near traffic lights 420, 430, 440, 450, 460, 470, 421, 431, 441, 451, 461, 471 programmed to monitor for signals transmitted from emergency vehicles. In some implementations, the presence of an emergency vehicle may be detected by the traffic light system 400 based on an exchange of information with emergency or law enforcement systems, which may track the locations of emergency vehicles or emergency situations, such as accidents, criminal activity, or fires, as non-limiting examples. In some embodiments, pairing the traffic light system 400 with other external systems may allow for increased situational awareness, which may allow for more effective and efficient management of traffic flow without necessarily requiring installation of additional hardware.

Figure 5:
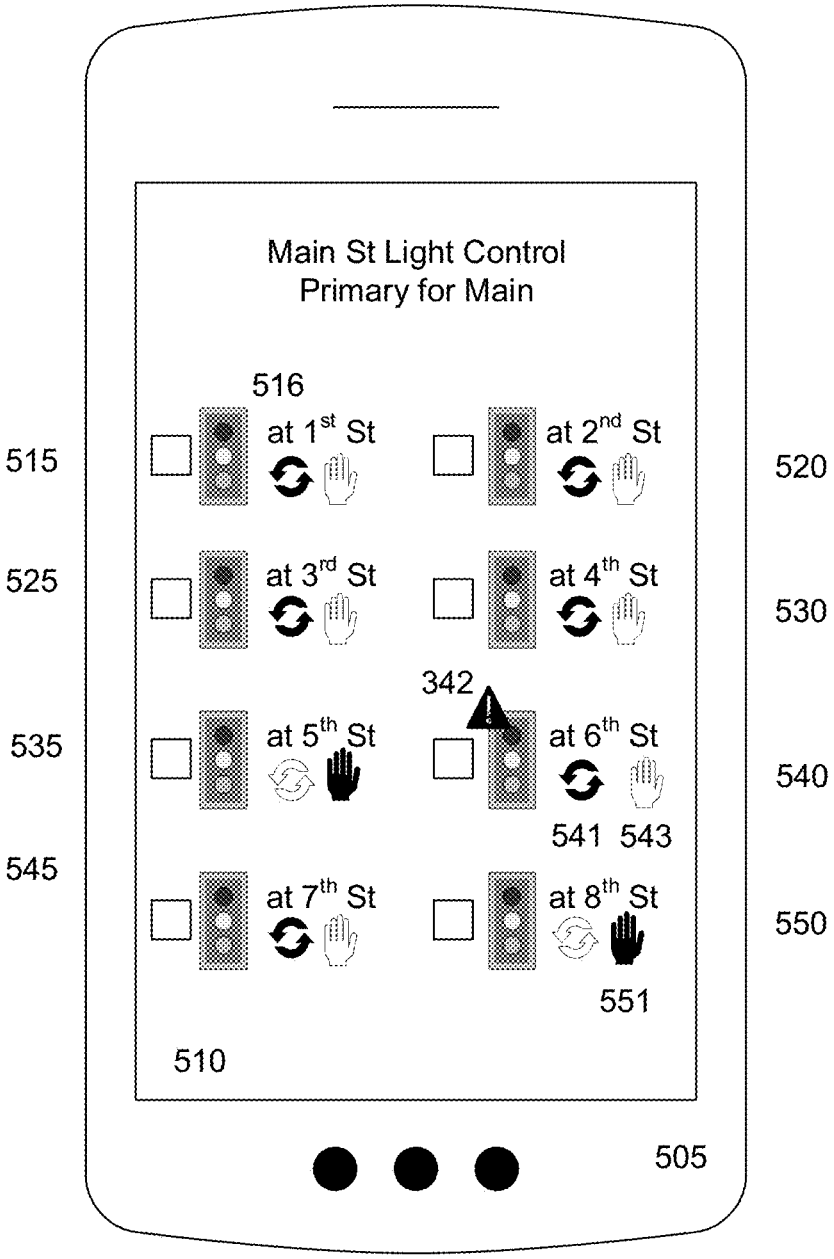
FIG. 5 illustrates an exemplary master light graphical user interface (GUI) on a mobile device, wherein master lights along Main Street may be controlled and coordinated.

Referring now to FIG. 5, an exemplary master light graphical user interface (GUI) 510 is illustrated on a mobile device 505, wherein master lights 515, 520, 525, 530, 535, 540, 545, 550 along Main Street may be controlled and coordinated. In some aspects, each of the master lights 515, 520, 525, 530, 535, 540, 545, 550 may be controlled manually 551 or through synchronization 516, 541 with other lights. In some embodiments, there may be a mix, wherein some of the master lights 515, 520, 525, 530, 535, 540, 545, 550 may be manually controlled and some may operate automatically through synchronization.

For example, at 5$^{th}$ Street and Main, there may be a school exit, and during certain hours the master light 535 may be manually controlled to allow for the school traffic. In some aspects, school traffic may be considered predictable, wherein a manual override may not be necessary and the traffic pattern may be preprogrammed into the traffic light system In some aspects, traffic patterns may be less predictable. For example, at 6$^{th}$ Street and Main Street, there may be a concert hall, which may periodically host shows and events. In some implementations, a user may receive an alert 542 when a manual override may be preferable. In some embodiments, such as where at least a portion of the intersections may be paired with traffic sensors, an alert 542 may be triggered when significant traffic congestion may be detected. In some aspects, such as where predefined third parties may be able to send notifications of action conditions, a third party may send an alert 542. For example, designated personnel from the concert hall may be able to notify the traffic light system when an event is taking place.

In some implementations, an alert 542 may be received in real time when the need for a manual override may be occurring. In some aspects, an alert 542 may be received in anticipation for a need for manual override. In some embodiments, alerts 542 may be received in anticipation and in real time, which may allow for the greatest flexibility.

For example, on Wednesday, designated personnel may send an alert 542 that a concert will be happening from 8 p.m. to 11 p.m. on Thursday, which may allow a user to toggle the master light 540 for that intersection from synchronization 541 to manual override 543 for that time period. As another example, an accident may occur at the intersection, and an emergency response vehicle may respond to the accident. The presence of the emergency response vehicle in proximity of the intersection may trigger an alert for a manual override to adjust for the traffic congestion that may be caused by the accident.

Figure 6:
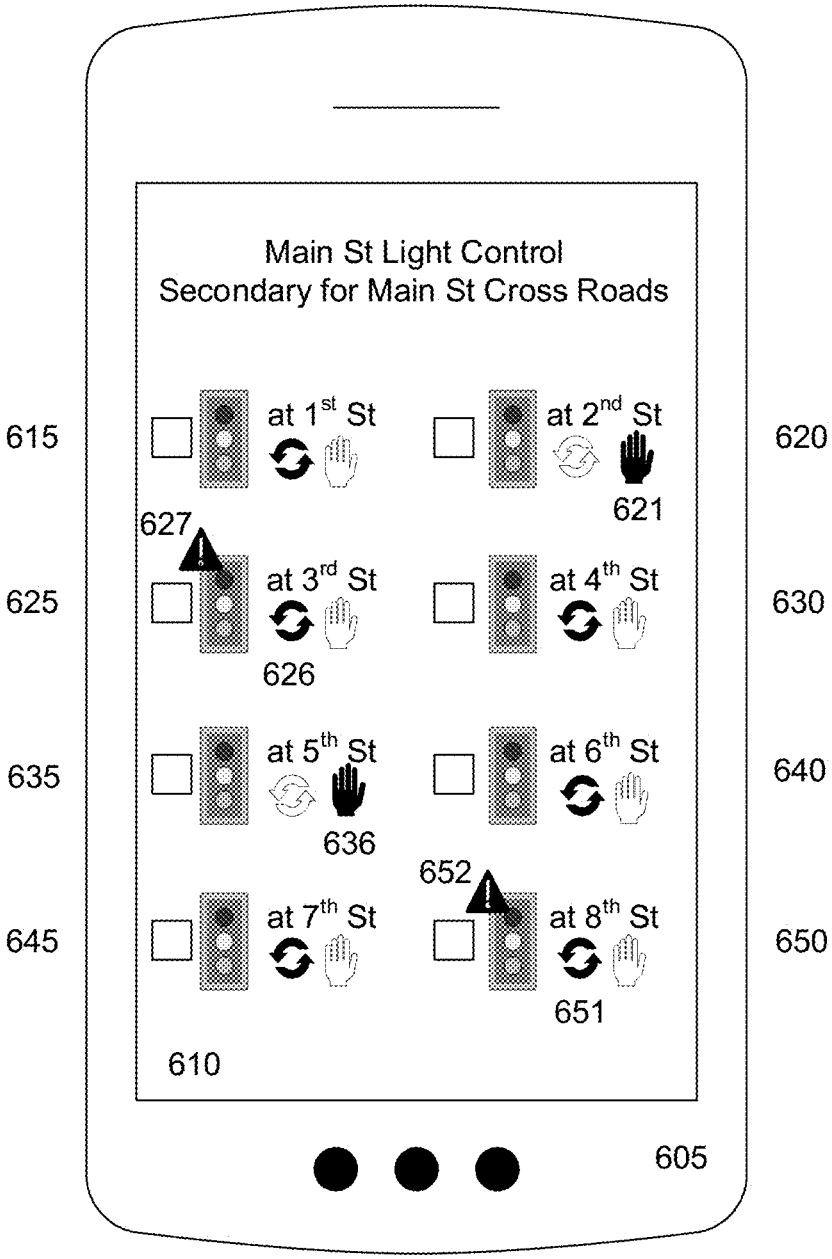
FIG. 6 illustrates an exemplary subordinate light GUI on a mobile device, wherein subordinate lights along crossroads of Main Street may be controlled and coordinated.

Referring now to FIG. 6, an exemplary subordinate light GUI 610 is illustrated on a mobile device 605, wherein subordinate lights 615, 620, 625, 630, 635, 640, 645, 650 for crossroads along Main Street may be controlled and coordinated. In some aspects, each of the subordinate lights 615, 620, 625, 630, 635, 640, 645, 650 may be controlled manually 621, 636 or through synchronization 626, 651 with other lights. In some aspects, a user may toggle between a subordinate light GUI 610 and a master light GUI, such as illustrated in FIG. 5, which may allow a user to effectively control and coordinate a traffic light system. In some aspects, users may access the subordinate light GUI 610 through mobile devices, such as a tablet, laptop, or smartphone, or a desktop device, such as a desktop computer.

In some aspects, manual override of a master light at an intersection may allow or require a manual override 636 of a subordinate light 635 in the same intersection. In some embodiments, manual override of a master light may prevent a manual override of a subordinate light, which may limit the ability to create conflicting setting priorities. In some embodiments, a subordinate light GUI 610 may indicate alerts 627, 652, which may notify a user of predefined circumstances, such as action conditions, manual override of a corresponding master light in an intersection, or a traffic light error, as non-limiting examples.

For example, the master light at 6$^{th}$ Street and Main Street may be under manual control, such as in response to an accident, and an alert status may be associated with the subordinate light 650 at 6$^{th}$ Street and Main Street to indicate that a manual override of subordinate light 650 may be prohibited at the time. As another example, the electricity at the subordinate light 625 for 3$^{rd}$ Street and Main Street may have gone out, and an alert 627 may prompt a user to send maintenance. The alert 627 may also prompt an override of the master light at the same intersection or of nearby traffic lights, as a way to mitigate traffic issues that may arise due to the outage.

In some aspects, a manual override 621, 636 may indicate that an action condition is occurring and the setting priorities may have allowed the traffic needs of the subordinate lights 620, 635 in those intersections to override the master lights. In some embodiments, a manual override 621, 636 may indicate that a user may be manually controlling the subordinate light 620, 635, such as when a malfunction may occur or a need for an emergency vehicle to pass through the intersection.

In some embodiments, a user may comprise designated individuals that may be allowed to view or manage a traffic light system. In some aspects, users may comprise designated individuals within government agencies associated with traffic control, such as the Department of Transportation. In some implementations, users may comprise designated individuals within emergency or law enforcement who may need limited access to override the traffic light system. In some embodiments, users may have limited access, such as the limited ability to only view or to send alerts regarding action conditions. In some aspects, such as described in FIGS. 4 and 5, users may comprise designated third parties who may be associated with action conditions, such as event venues or drawbridge attendants.

Figure 7:
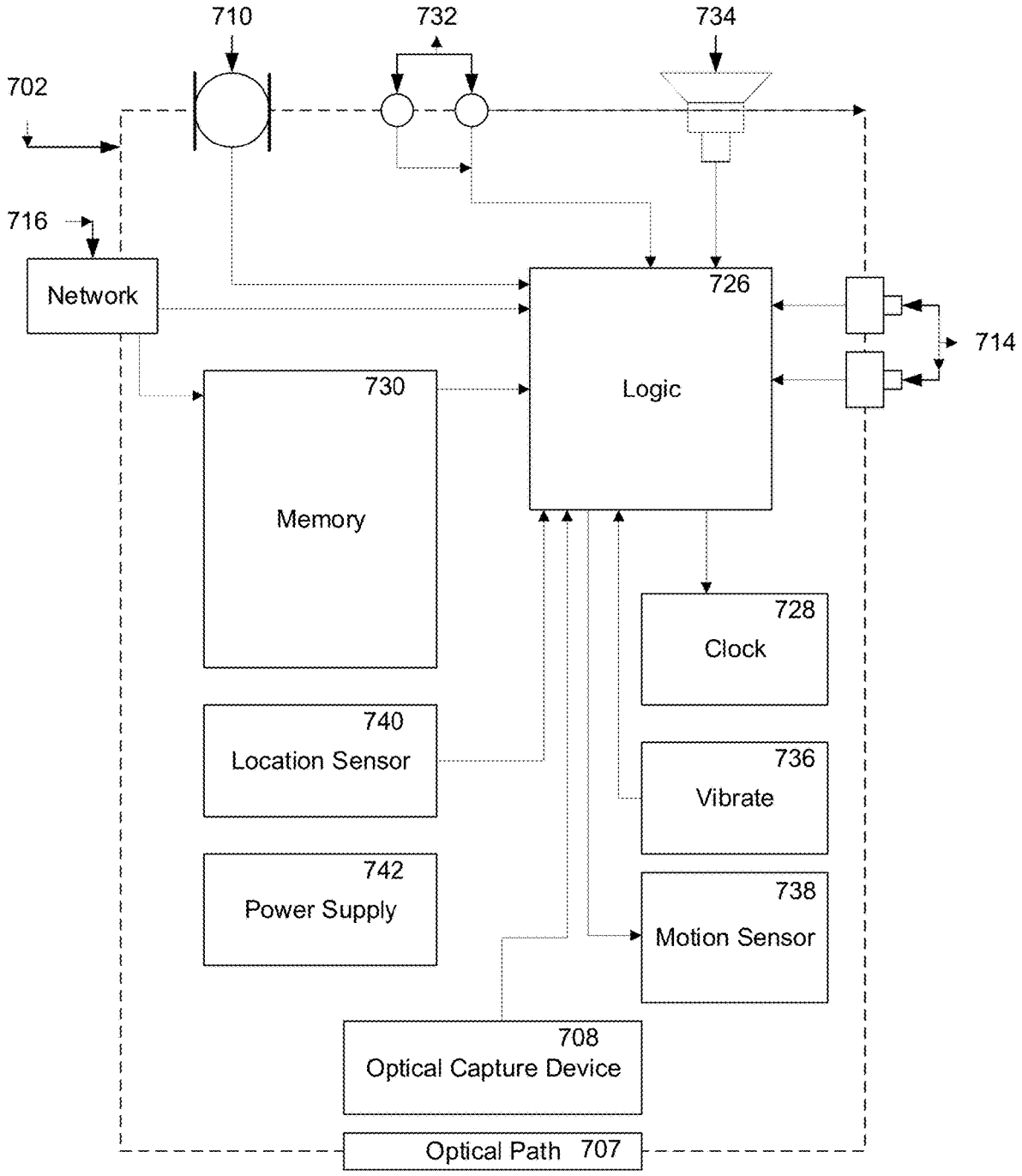
FIG. 7 illustrates an exemplary block diagram of an exemplary embodiment of a mobile device, according to some embodiments of the present disclosure.

Referring now to FIG. 7, an exemplary block diagram of an exemplary embodiment of a mobile device 702 is illustrated. The mobile device 702 may comprise an optical capture device 708, which may capture an image and convert it to machine-compatible data, and an optical path 706, typically a lens, an aperture, or an image conduit to convey the image from the rendered document to the optical capture device 708. The optical capture device 708 may incorporate a Charge-Coupled Device (CCD), a Complementary Metal Oxide Semiconductor (CMOS) imaging device, or an optical sensor of another type.

In some embodiments, the mobile device 702 may comprise a microphone 710, wherein the microphone 710 and associated circuitry may convert the sound of the environment, including spoken words, into machine-compatible signals. Input facilities 714 may exist in the form of buttons, scroll-wheels, or other tactile sensors such as touch-pads. In some embodiments, input facilities 714 may include a touchscreen display. Visual feedback 732 to the user may occur through a visual display, touchscreen display, or indicator lights. Audible feedback 734 may be transmitted through a loudspeaker or other audio transducer. Tactile feedback may be provided through a vibration module 736.

In some aspects, the mobile device 702 may comprise a motion sensor 738, wherein the motion sensor 738 and associated circuitry may convert the motion of the mobile device 702 into machine-compatible signals. For example, the motion sensor 738 may comprise an accelerometer, which may be used to sense measurable physical acceleration, orientation, vibration, and other movements. In some embodiments, the motion sensor 738 may comprise a gyroscope or other device to sense different motions.

In some implementations, the mobile device 702 may comprise a location sensor 740, wherein the location sensor 740 and associated circuitry may be used to determine the location of the device. The location sensor 740 may detect Global Position System (GPS) radio signals from satellites or may also use assisted GPS where the mobile device may use a cellular network to decrease the time necessary to determine location. In some embodiments, the location sensor 740 may use radio waves to determine the distance from known radio sources such as cellular towers to determine the location of the mobile device 702. In some embodiments these radio signals may be used in addition to and/or in conjunction with GPS.

In some aspects, the mobile device 702 may comprise a logic module 726, which may place the components of the mobile device 702 into electrical and logical communication. The electrical and logical communication may allow the components to interact. Accordingly, in some embodiments, the received signals from the components may be processed into different formats and/or interpretations to allow for the logical communication. The logic module 726 may be operable to read and write data and program instructions stored in associated storage 730, such as RAM, ROM, flash, or other suitable memory. In some aspects, the logic module 726 may read a time signal from the clock unit 728. In some embodiments, the mobile device 702 may comprise an on-board power supply 732. In some embodiments, the mobile device 702 may be powered from a tethered connection to another device, such as a Universal Serial Bus (USB) connection.

In some implementations, the mobile device 702 may comprise a network interface 716, which may allow the mobile device 702 to communicate and/or receive data to a network and/or an associated computing device. The network interface 716 may provide two-way data communication. For example, the network interface 716 may operate according to an internet protocol. As another example, the network interface 716 may comprise a local area network (LAN) card, which may allow a data communication connection to a compatible LAN. As another example, the network interface 716 may comprise a cellular antenna and associated circuitry, which may allow the mobile device to communicate over standard wireless data communication networks. In some implementations, the network interface 716 may comprise a Universal Serial Bus (USB) to supply power or transmit data. In some embodiments, other wireless links known to those skilled in the art may also be implemented.

Figure 8:
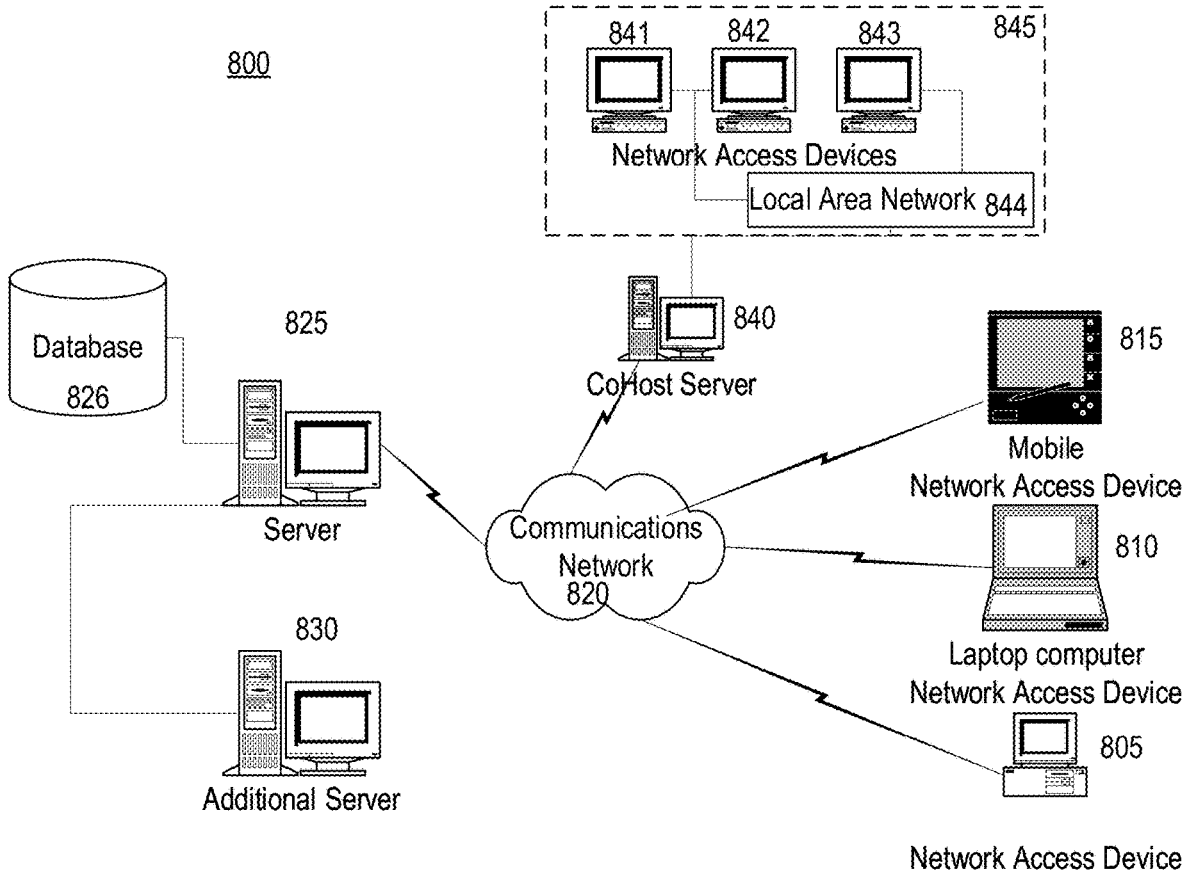
FIG. 8 illustrates apparatus that may be used to implement aspects of the present disclosure, including executable software.

Referring now to FIG. 8, an exemplary processing and interface system 800 is illustrated. In some aspects, access devices 815, 810, 805, such as a paired portable device 815 or laptop computer 810 may be able to communicate with an external server 825 though a communications network 820. The external server 825 may be in logical communication with a database 826, which may comprise data related to identification information and associated profile information. In some embodiments, the server 825 may be in logical communication with an additional server 830, which may comprise supplemental processing capabilities.

In some aspects, the server 825 and access devices 805, 810, 815 may be able to communicate with a cohost server 840 through a communications network 820. The cohost server 840 may be in logical communication with an internal network 845 comprising network access devices 841, 842, 843 and a local area network 844. For example, the cohost server 840 may comprise a payment service, such as PayPal or a social network, such as Facebook or a dating website.

Figure 9:
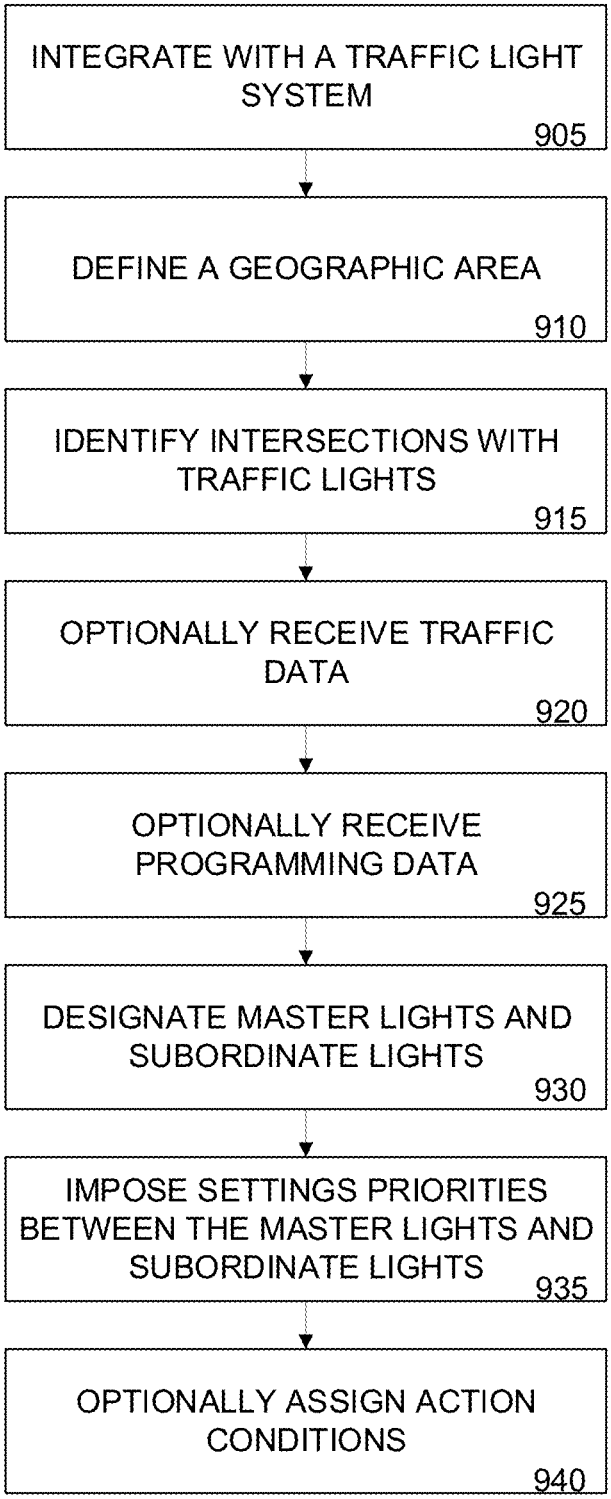
FIG. 9 illustrates exemplary method steps for controlling a traffic light system, according to some embodiments of the present disclosure.

Referring now to FIG. 9, exemplary method steps for controlling a traffic light system is illustrated. At 905, a controlling device may be integrated with a traffic light system. At 910, a geographic area of traffic may be defined. At 915, intersections with traffic lights may be identified. In some aspects, at 920, traffic data may be received. In some embodiments, at 925, programming data may be received. In some implementations, the system may be remotely programmed, such as through an external device as illustrated in FIGS. 5-6. At 930, master lights and subordinate lights may be designated. At 935, setting priorities between master lights and subordinate lights may be imposed. In some aspects, at 940, action conditions may be assigned to one or more traffic light.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A traffic light system for managing traffic flow, the traffic light system comprising:

a first master light comprising a traffic light located at a first intersection within a predefined geography;

a first subordinate light located at a second intersection within the predefined geography, wherein the first subordinate light is responsive to the first master light;

a first set of setting priorities, wherein the first set of setting priorities determine an order of priority of responsiveness between the first master light and the first subordinate light;

a second set of setting priorities, wherein the second set of setting priorities change the order of priority of responsiveness and change the first master light into a second subordinate light and the first subordinate light into a second master light, wherein the change in the order of priority is based at least in part on predictive algorithms; and at least a first precision timing mechanism in logical communication with at least the first master light, wherein the first precision timing mechanism is configured to synchronize responsiveness between the first master light and the first subordinate light.

2. The system of claim 1, wherein the first subordinate light is part of a subordinate light group comprising a plurality of subordinate lights, wherein a first set of setting priorities controls a hierarchy between the plurality of subordinate lights and the first master light.

3. The system of claim 2, wherein one or more of the first master light and the plurality of subordinate lights are triggerable by action conditions, wherein an action condition comprises an external condition.

4. The system of claim 3, wherein at least one action condition comprises an emergency vehicle proximity.

5. The system of claim 2, wherein a first master light and a first subordinate light are located at a first intersection, wherein the first master light controls a first direction and the first subordinate light controls a second direction.

6. The system of claim 5, wherein the first direction is perpendicular to the second direction.

7. The system of claim 5, wherein the first direction is opposite to the second direction.

8. The system of claim 5, wherein the first intersection further comprises a second subordinate light.

9. A traffic light system comprising:

a plurality of master lights comprising traffic lights located at a first plurality of intersections within a predefined geography;

a plurality of subordinate lights located at a second plurality of intersections within the predefined geography, wherein at least a portion of the plurality of subordinate lights are temporarily designated as a portion of the plurality of master lights;

a plurality of setting priorities, wherein the plurality of setting priorities determine an order of priority of responsiveness between the plurality of master lights and the plurality of subordinate lights, wherein a change between the plurality of setting priorities changes the priority of responsiveness between the plurality of master lights and the plurality of subordinate lights, and wherein the change between the plurality of setting priorities is based at least in part on predictive algorithms; and at least one precision timing mechanism in logical communication with at least one of the plurality of master lights, wherein the at least one precision timing mechanism is configured to synchronize responsiveness between the at least one of the plurality of master lights and at least one of the plurality of subordinate lights.

10. The system of claim 9, wherein the at least one precision timing mechanism comprises an atomic clock.

11. The system of claim 9, wherein one or more of the plurality of subordinate lights and the plurality of master lights is triggerable by at least one action condition, wherein an action condition comprises an external condition.

12. The system of claim 9, wherein the first plurality of intersections at least partially overlap with the second plurality of intersections.

13. The system of claim 12, wherein at least one action condition comprises an emergency vehicle proximity.

14. A synchronization device for managing a traffic light system comprising:

a precision timing mechanism;

a processor logically connectable to a system of traffic lights comprising a plurality of traffic lights, wherein the processor when connected to the system of traffic lights, is configured to:

designate at least one master light from the plurality of traffic lights, wherein at least one designation as master light is temporary;

designate at least one subordinate light from the plurality of traffic lights, wherein at least one designation as subordinate light is temporary;

impose settings priorities on the at least one master light and the at least one subordinate light, wherein the setting priorities is changeable based at least in part on predictive algorithms; and synchronize the at least one master light and the at least one subordinate light, wherein synchronization is at least partially based on timing data received from the precision timing mechanism.

15. The device of claim 14, wherein the device is configured to removably integrate into an existing traffic light system.

16. The device of claim 14, wherein the device is configured to integrate into a new traffic light system.

17. The device of claim 14, wherein the device is programmable, wherein programming controls one or more of master light designation, subordinate light designation, and settings priorities.

18. The device of claim 17, wherein the device is wirelessly programmable.

19. The device of claim 14, wherein the processor is further configured to associate at least one action condition with one or more designated master lights and designated subordinate lights.

20. The device of claim 19, wherein the device is logically connected to sensors of the system of traffic lights.

* * * * *